US007464446B2

(12) United States Patent
Johansson

(10) Patent No.: US 7,464,446 B2
(45) Date of Patent: Dec. 16, 2008

(54) METHOD AND DEVICE FOR IMPROVING THE FRICTIONAL ENGAGEMENT BETWEEN TWO CONTRACT SURFACES

(76) Inventor: Dan Johansson, Box 94, Bollebygd (SE) SE-517 22

( * ) Notice: Subject to any disclaimer, the term of this patent is extended or adjusted under 35 U.S.C. 154(b) by 779 days.

(21) Appl. No.: 10/296,041

(22) PCT Filed: May 18, 2001

(86) PCT No.: PCT/SE01/01114

§ 371 (c)(1),
(2), (4) Date: Aug. 29, 2003

(87) PCT Pub. No.: WO01/90466

PCT Pub. Date: Nov. 29, 2001

(65) Prior Publication Data

US 2004/0062918 A1 Apr. 1, 2004

(30) Foreign Application Priority Data

May 22, 2000 (SE) ..... 0001889

(51) Int. Cl.
*A44B 21/00* (2006.01)

(52) U.S. Cl. ..... 24/442; 2/161.2; 2/161.3; 2/161.8; 428/120; 473/205; 473/302

(58) Field of Classification Search ..... None
See application file for complete search history.

(56) References Cited

U.S. PATENT DOCUMENTS

| | | | | |
|---|---|---|---|---|
| 4,827,535 | A | 5/1989 | Socey | |
| 5,774,895 | A | 7/1998 | Baldwin | |
| 5,908,206 | A | 6/1999 | LoPresti, Jr. | |
| 6,372,323 | B1 * | 4/2002 | Kobe et al. | 428/119 |

FOREIGN PATENT DOCUMENTS

| | | |
|---|---|---|
| EP | 0070268 | 7/1982 |

* cited by examiner

*Primary Examiner*—Jack W. Lavinder
(74) *Attorney, Agent, or Firm*—Sughrue Mion, PLLC

(57) ABSTRACT

Method for obtaining an improved but easily adjustable and releasable frictional engagement between two contact surfaces. According to the method, both contact surfaces are provided with material layers (2, 4) which, when there is low contact pressure between the contact surfaces, ensure that these surfaces are able to move comparatively easily in relation to each other, but, when there is higher contact pressure, these material layers engage in each other and make relative movement between the contact surfaces impossible or substantially difficult. This can be achieved by means of both contact surfaces being flocked with a layer of short fibers (5), in particular synthetic fibers. The invention also relates to an arrangement for obtaining an improved frictional engagement between two contact surfaces and to objects provided with such contact surfaces.

7 Claims, 1 Drawing Sheet

Fig 1
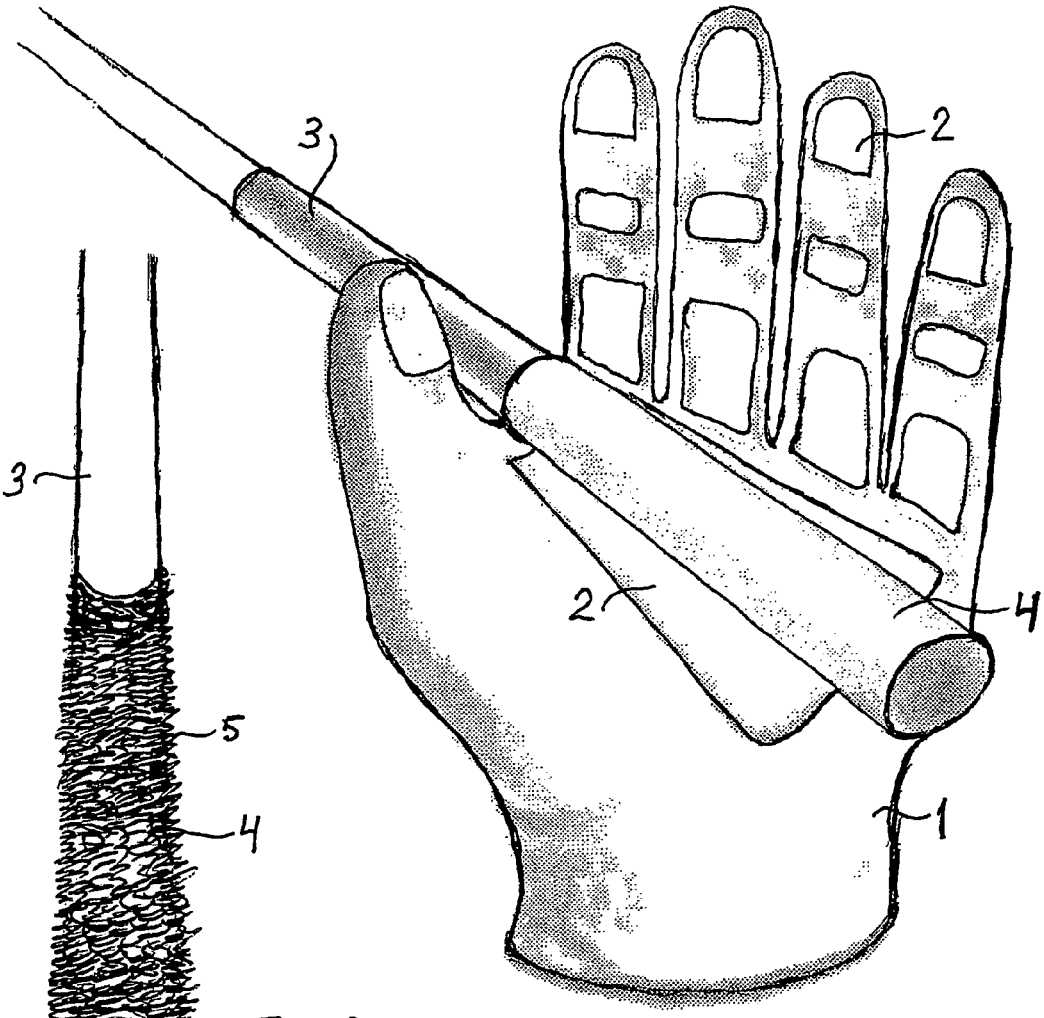
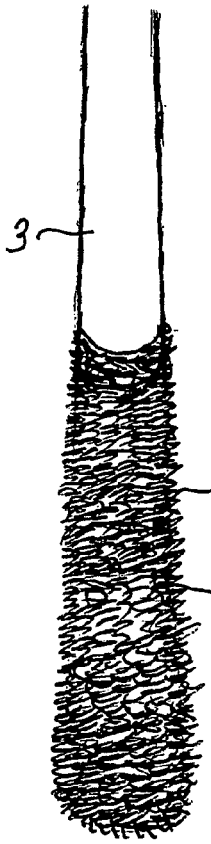
Fig 2
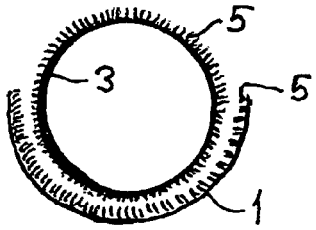
Fig 3
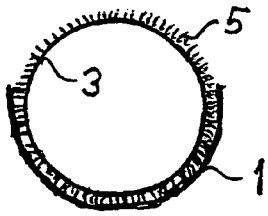
Fig 4

METHOD AND DEVICE FOR IMPROVING THE FRICTIONAL ENGAGEMENT BETWEEN TWO CONTRACT SURFACES

FIELD OF THE INVENTION

The present invention relates to a method for obtaining an improved but easily adjustable frictional engagement between two contact surfaces. The invention relates in particular to improving the grip round a hand-held object, for example an item of sports equipment, a tool or the like.

The invention also relates to an arrangement for obtaining an improved but easily adjustable frictional engagement between two contact surfaces and to products designed with such contact surfaces.

BACKGROUND TO THE INVENTION

There are many situations where, after adjusting two contact surfaces in relation to each other, it is desirable to temporarily lock the surfaces in the adopted positions, without any possibility of them sliding. To adjust the position or to assume new relative positions between the contact surfaces, they must be able to be easily released from each other again.

There are innumerable examples of when a function as set out above is sought. One example is that of golf clubs, in the case of which the player, before taking a shot, wants to be able to adjust his grip round the club shaft to the exact position desired, and, when this position has been reached, to lock the club shaft securely between the hands in the adopted position. To solve this problem, it has previously been proposed to use different materials for the club handle which, together with a friction glove, is intended to give the best possible grip, see for example U.S. Pat. No. 3,649,967. However, no entirely satisfactory material combinations have as yet been developed which do not entail a risk of relative turning between the shaft and hands. In moist conditions or rain, the problems are aggravated because the friction between club shaft and glove is reduced.

Corresponding problems are also found in other sports where one has to be able to securely hold an item of sports equipment, for example various rackets, hockey and bandy clubs, baseball bats, bicycle and motorbike handles, steering wheels in cars, reins in equestrian sports, etc. The problems are at their worst in rainy weather and in extremely hot conditions as a consequence of sweat on the hands.

Similar requirements also exist in other areas, for example in tool work, for gripping a hammer, a screwdriver shaft, etc.

OBJECT OF THE INVENTION

A main object of the present invention is to make available a technique by which it is possible to obtain an improved but easily adjustable and releasable frictional engagement between two contact surfaces.

The basis of the invention is the recognition that such a grip should be designed in such a way that, when there is low contact pressure between the contact surfaces, these surfaces are able to move in relation to each other, but, when there is higher contact pressure, they make this relative movement largely impossible.

To achieve this object, a method according to the present invention is characterized in that both contact surfaces are provided with a layer of short fibres which project from the respective surface and which, when there is low contact pressure between the contact surfaces, ensure that these surfaces can move comparatively easily in relation to each other, but which fibre layers, in the event of higher contact pressure, engage in each other and make relative movement between the contact surfaces impossible or substantially difficult.

By means of this method it is possible, for example in the case of a hand-held object, to adjust the position of the hand relative to the object when holding the latter loosely and, when the correct position has been reached, to activate the frictional locking between the hand and the object by squeezing harder round the object. This is done entirely naturally in the case of, inter alia, the abovementioned hand-held items of sports equipment and tools, as can be illustrated by the example of a golf club. When the golfer is about to take a shot, he quite naturally has to grip hard round the club shaft, the latter being automatically locked in the previously carefully adjusted position in relation to the hands. Activation of the frictional engagement therefore does not require any particular manoeuvre or special measure, and instead it happens automatically when the user uses the equipment or tool, for example a club, a racket or a hammer, in the manner intended.

To obtain the two aforementioned friction layers, it is preferable for each contact surface to be flocked with a layer of short fibres. The fibres should be short and stiff and consist expediently of synthetic fibres, preferably polyamide. Other possible materials are rayon, polyester, acryl, etc. The length can be of the order of 0.3 to 1.0 mm, preferably 0.5-0.7 mm, and the weight per length can expediently be 4.0, 6.7, 11.0 or 22.0 dtex and, on the basis of trials hitherto carried out, is preferably 6.7 dtex.

The flocking is usually carried out by means of the surfaces which are to be flocked being coated with an adhesive, after which the flocking fibres are oriented and accelerated towards the adhesive-coated surfaces with the aid of an electrostatic field. This technique is already known per se and will not be described in any detail here. Other methods of flocking can also be used, however.

When the invention is applied to improve the grip round a hand-held object such as an item of sports equipment, a tool or the like, one fibre layer can be applied over at least part of the grip surface of a glove or the like fitted on a user's hand, and the other fibre layer is applied over at least part of the grip area of the object which is to be gripped. This results in the above-described function in which the hand wearing the glove can move relative to the grip area as long as the gripping force of the hand round the grip area of the object is locked whereas the object is locked securely in the adopted position relative to the hand when the grip around it increases.

The same type of fibre layer is preferably flocked on both the glove and the object which is to be gripped. The fibre layer can then either be flocked directly on a glove or the like, or it is flocked on a thin support which is in turn applied to a glove or wound directly round the hand.

With the technique described above it is thus possible to obtain, inter alia, a very secure frictional engagement around a hand-held object, which frictional engagement can be regulated using the force with which the object is gripped.

A product manufactured in accordance with the invention can be in the form of a glove or the like provided with a flocked fibre layer or alternatively provided with a thin support which is applied to the glove and which is provided with the flocked fibre layer.

The invention will be described in more detail below with reference to the attached drawings.

BRIEF DESCRIPTION OF THE FIGURES

FIG. 1 illustrates the grip between a golf glove and a golf club, both of which are provided with friction layers according to the present invention.

FIG. 2 illustrates diagrammatically the upper grip area of a golf club provided with a friction layer according to the invention.

FIG. 3 illustrates diagrammatically a section through the club shaft and part of the glove according to FIG. 1 during adjustment of the grip.

FIG. 4 illustrates diagrammatically how the friction layers in FIG. 3 are locked to each other when pressed together.

DESCRIPTION OF A PREFERRED EMBODIMENT

In FIG. 1, reference number 1 designates a golf glove whose grip surfaces, i.e. the palm and the inside of the finger portions, are provided with friction layers 2. The position and configuration of these can be varied according to requirements, and alternatively the whole grip surface of the glove can be covered with such a friction layer. Reference number 3 designates the shaft of a golf club whose upper grip area is covered with a friction layer 4. In the embodiment shown, the friction layer 4 is continuous. However, this can be replaced by, for example, band-shaped areas of friction layers.

As is illustrated in FIGS. 2 and 3, the friction layers consist of short fibres 5 which have been flocked directly onto the glove 1 and the club shaft 3. Alternatively, they can be flocked onto a thin flexible support, such as a cloth or a band, which is then applied to the glove or wound round the club shaft. Such a band can expediently be designed to be self-adhesive.

For flocking of the fibres, those surfaces which are to be flocked are first coated with adhesive, after which short fibres are accelerated and oriented towards the adhesive-coated surfaces with the aid of an electrostatic field. The result is a fibre layer with a very large number of short fibres closely adjacent to each other and projecting from the adhesive layer. Trials with fibres of polyamide having a length of 0.5 to 0.7 mm and a weight per length of 6.7 or 11.0 dtex have shown these to provide a very good effect.

When there is a low contact pressure between the fibre layers, see FIG. 3, these can move comparatively easily relative to each other. However, at higher contact pressure, see FIG. 4, the fibre layers engage in one another, which makes relative movements between the two fibre layers largely impossible.

When using a golf glove and golf club provided with friction layers according to FIG. 1, the player first adjusts his grip round the club shaft, after which he grips hard round the shaft when playing his shot. This shaft is thus locked securely and exactly in the adopted position relative to the hand without any possibility of further movement relative to the hand.

Besides a glove, it is possible for a product according to the invention to be in the form of some other type of arrangement which can be secured on the hand and supports the flocked fibre layer. The fibre layer can also be flocked on a band or equivalent, which is expediently self-adhesive, and which can be wound round the hand, with or without a glove.

The item of sports equipment, the tool, etc., to be gripped using such a glove or equivalent is designed, according to the above, with a correspondingly flocked grip part, see FIG. 2. The flocking can be arranged directly on the object or on a cloth or a band which is wound round or otherwise applied to the object which is to be gripped. In the case of a golf club, for example, all or one or more parts of the normal grip area can be provided with a flocked fibre layer.

Although the invention will probably be most relevant in connection with hand-held devices, a corresponding technique for increasing friction can also be used in other contexts, for example where an object is gripped with the aid of automatically controlled grippers or the like.

The invention claimed is:

1. Method for obtaining an improved but easily adjustable and releasable frictional engagement between two contact surfaces, characterized in that both contact surfaces are flocked with a layer of short and substantially straight fibres, that the fibre layers on both contact surfaces are of the same kind, and that the fibres project from the respective surface, so that, when there is low contact pressure between the contact surfaces, these surfaces are able to move comparatively easily in relation to each other, but, when there is higher contact pressure, the fibre layers on the contact surfaces engage in each other and make relative movement between the contact surfaces impossible or substantially difficult.

2. Method according to claim 1, characterized in that the contact surfaces are flocked with synthetic fibres having a length of the order of 0.3 to 1.0 mm, preferably 0.5 to 0.7 mm.

3. Method according to claim 1, intended to improve the grip round a hand-held object comprising at least one of an item of sports equipment and a tool, characterized in that one fibre layer is applied over at least part of the grip surface of a glove fitted on a user's hand, and in that the other fibre layer is applied over at least part of the grip area of the object which is to be gripped.

4. Method according to claim 3, characterized in that the same type of fibre layer is flocked on the glove and on the object which is to be gripped.

5. Method according to claim 3, characterized in that a fibre layer is flocked directly on the glove.

6. Method according to claim 3, characterized in that a thin support with a flocked fibre layer is applied to the glove or wound directly round the hand.

7. Method for obtaining an improved but easily adjustable and releasable frictional engagement between two contact surfaces, characterized in that both contact surfaces are flocked with a layer of short and substantially straight fibres, that the fibre layers on both contact surfaces are of the same kind, and that the fibres project from the respective surface, so that, when there is low contact pressure between the contact surfaces, these surfaces are able to move comparatively easily in relation to each other, but, when there is higher contact pressure, the fibre layers on the contact surfaces engage in each other and make relative movement between the contact surfaces impossible or substantially difficult, said method being further characterized in that the contact surfaces are flocked with synthetic fibres having a weight per length of 4.0, 6.7, 11.0 or 22.0 dtex, preferably 6.7 dtex.

* * * * *